US006334802B1

(12) United States Patent
Fukuta et al.

(10) Patent No.: US 6,334,802 B1
(45) Date of Patent: Jan. 1, 2002

(54) ELECTRODE FOR A DISPLAY DEVICE AND METHOD FOR MANUFACTURING THE SAME

(75) Inventors: Shin'ya Fukuta; Hiroyasu Kawano, both of Kawasaki; Hideki Harada, Kagoshima, all of (JP)

(73) Assignee: Fujitsu Ltd., Kawasaki (JP)

( * ) Notice: Subject to any disclaimer, the term of this patent is extended or adjusted under 35 U.S.C. 154(b) by 0 days.

(21) Appl. No.: 09/716,333

(22) Filed: Nov. 21, 2000

Related U.S. Application Data

(62) Division of application No. 08/104,672, filed on Jun. 25, 1998, now Pat. No. 6,191,530.

(30) Foreign Application Priority Data

Aug. 13, 1997 (JP) ..... 9-233375
Jun. 11, 1998 (JP) ..... 10-181478

(51) Int. Cl.[7] ..... H01J 9/02
(52) U.S. Cl. ..... 445/24
(58) Field of Search ..... 445/24; 313/582–586

(56) References Cited

U.S. PATENT DOCUMENTS 5,818,168 A * 10/1998 Ushifusa et al. ..... 313/582
5,838,398 A 11/1998 Ilcisin et al. ..... 313/584 X
5,900,694 A * 5/1999 Matsuzaki et al. ..... 313/484
5,939,827 A 8/1999 Hinchliffe ..... 313/586 X
6,140,761 A * 1/2000 Fushimi et al. ..... 313/495
6,156,433 A * 12/2000 Hatori et al. ..... 428/411.1

FOREIGN PATENT DOCUMENTS

JP 8-222128 8/1996
JP 8-337656 9/1996
JP 9-022655 1/1997

* cited by examiner

*Primary Examiner*—Kenneth J. Ramsey
(74) *Attorney, Agent, or Firm*—Armstrong, Westerman, Hattori, McLeland & Naughton, LLP

(57) ABSTRACT

An electrode for a display device, including a laminate of an underlying layer, a conductive layer and a protective layer formed on a substrate in this order from the substrate side in such a manner that at least the conductive layer is completely covered by the protective layer, the underlying layer and the protective layer being composed of a metal which is hard to form an alloy or intermetallic compound with the metal constituting the conductive layer and has a low solid solubility to the conductive layer.

6 Claims, 13 Drawing Sheets

ELECTRODE FOR A DISPLAY DEVICE AND METHOD FOR MANUFACTURING THE SAME

This application is a division of prior application Ser. No. 08/104,672, filed Jun. 25, 1998, now U.S. Pat. No. 6,191, 530.

CROSS-REFERENCE TO RELATED APPLICATIONS

This application is related to Japanese patent application No.HEI9(1997)-233375, filed on Aug. 13, 1997 and a Japanese patent application filed on Jun. 11, 1998, of which application number has not been provided yet, whose priority is claimed under 35 USC §119, the disclosure of which is incorporated herein by reference in its entirety.

BACKGROUND OF THE INVENTION

1. Field of the Invention

The present invention relates to an electrode for a display device and method for manufacturing the same. The electrode for a display device and method for manufacturing the same of the present invention can be suitably used for electrodes of a plasma display panel (PDP), a liquid crystal display device (LCD) or the like.

2. Related Art

First, there is PDP as a typical display device in which an electrode is formed on a substrate. PDP is a self-light-emitting type display device. FIG. 7 shows a schematic slant view of PDP of a surface-discharging alternating current driving system. As shown in FIG. 7, a PDP 20 has a construction that a substrate 23 equipped with barrier ribs 21 and address electrodes A (data electrodes), each covered with a phosphor layer 22, is stuck to a substrate 27 equipped with display electrodes (each is a double-layer electrode of a transparent electrode 25 and a metal electrode 26) covered with a dielectric layer 24 made of a low-melting glass. The transparent electrode 25 is made of a transparent electrically conductive film of ITO (indium tin oxide), NESA ($SnO_2$) or the like. The metal electrode (bus electrode) 26 has a width narrower than the transparent electrode 25 and is laminated thereon. The phosphor layers 22 are formed in a stripe form (EU in FIG. 7) and emit R (red), G (green), and B (blue) lights with the excitation of the vacuum ultraviolet light raised by gas discharge between the adjacent display electrodes. One RGB set corresponds to one pixel (EG in FIG. 7). In addition, the substrate 23 side is called a rear-side substrate and the substrate 27 side is called a display-side substrate. Also, in FIG. 7, the numeral 28 denotes a dielectric layer, 29 denotes a discharging protective layer, and D denotes a display surface.

As a method of producing the address electrode and the bus electrode, for example, a method of coating a metal paste containing Ag on a substrate by the printing method and burning to produce the electrode made of Ag and a method of producing an electrode made of three layers of Cr/Cu/Cr or Al or an Al alloy or the like, by the thin film-forming method such as the sputtering method have been known.

In the case of producing the address electrode and the bus electrode by utilizing the printing method, there was a problem that the formation of high-precision patterns having a width from about 10 to 20 $\mu$m is difficult. Also, in the case of using a thin film-forming method used for manufacturing semiconductor devices, it was possible to form high-precision patterns, but there was a problem that the production apparatus, materials, or the like, are more expensive than those of other methods. Furthermore, because Cu has a property that it is liable to be diffused in a low-melting glass, there was a possibility that in the electrode made of three layers of Cr/Cu/Cr, Cu exposed at the side surface is diffused in the formation of the dielectric layer at a temperature ranging about the softening point of the low-melting glass. By diffusing Cu, there was a problem that the low-melting glass is colored and color purity of color display is deteriorated.

As a method of solving these problems, the method described in Japanese Unexamined Patent Publication (Kokai) No. 8-227656 is known. Practically, the electrode is produced by the method shown in FIGS. 11(*a*) to 11(*d*).

In the method shown in FIGS. 11(*a*) to 11([<m]ditd), first, a Ni layer 31 is formed on a substrate 30 [see, FIG. 11(*a*)]. Then, a resist layer 32 is coated on the whole surface of the Ni layer 31, and an opening is formed on a desired region of the Ni layer 31. Thereafter, a Cu layer 33 is formed in the opening by the electroplating method [see, FIG. 11(*b*)]. Then, the resist layer 32 is removed, and after patterning the Ni layer 31 in a desired form [see, FIG. 11(*c*)], a Ni layer 34 is selectively formed on the surface of the Cu layer 33 by the electroless plating method, whereby the bus electrode made of the Ni layer 31, the Cu layer 33 and the Ni layer 34 can be formed [see, FIG. 11(*d*)].

Also, as another method, the method described in Japanese Unexamined Patent Publication (Kokai) No. 8-222128 is known. Practically, the electrode is produced by the method shown in FIGS. 13(*a*) to 13(*c*). In this method, a transparent electrode 42 is formed on a substrate 41 in a desired form, then a Ni layer 43 is formed on the whole surface of the substrate 41, and further, a Cu layer 44 is formed on the Ni layer 43 in a desired form [see, FIG. 13(*a*)]. Thereafter, the Ni layer 43 is etched so that the Ni layer has the same plane form as the Cu layer 44 [see, FIG. 13(*b*)], and a resist layer 45 is formed and opened so that the Ni layer 43 and the Cu layer 44 are exposed. Thereafter, a Ni layer 46 is formed by the plating method so that the Ni layer 46 covers the Ni layer 43 and the Cu layer 44.

The methods described in the former publications have an advantage that an electrode of a high-precision pattern can be easily produced at a low cost.

However, in the case of covering the electrode with a dielectric layer made of a low-melting glass by sintering a low-melting glass paste, because the electrode is heated to a high temperature at sintering, there was a problem that Cu and Ni of the electrode material are mutually diffused to form an alloy, thereby increasing the resistance. The point that Cu and Ni form an alloy is shown in the phase diagram of Cu—Ni in "*Constitution of Binary Alloys*", (Max Hansen, 2nd Ed., page 602, published by McGraw-Hill Book Company). This literature shows that, because the completely mixed state of Cu and Ni is thermodynamically stable, they can be easily mixed to form an alloy thereof upon heating at sintering.

Now, FIG. 12(*a*) is an SEM (scanning electron microscope) photograph of the cross-section of an electrode made of Ni/Cu/Cr from the substrate side, and FIG. 12(*b*) is an SEM photograph of the cross-section after heating the above-described Ni/Cu/Cr at 600° C. for 40 minutes. FIG. 12(*b*) shows that Cu and Ni are diffused to form an alloy thereof.

However, in the method in the later publication, there was a further problem that, because the number of steps is increased, the production cost is increased.

SUMMARY OF THE INVENTION

An object of the present invention is to provide an electrode whose resistance does not increase by forming an alloy or the like and to produce the electrode without increasing the number of steps in the production. Further, in the case of covering an electrode with a dielectric layer, an object of the present invention is to provide such an electrode that coloring of the dielectric layer can be prevented and a method for manufacturing the same, the coloring caused by diffusion of metals constituting the electrode.

That is, according to a first aspect of the present invention, there is provided an electrode for a display device, comprising a laminate of an underlying layer, a conductive layer and a protective layer formed on a substrate in this order from the substrate side in such a manner that at least the conductive layer is completely covered by the protective layer, the underlying layer and the protective layer being composed of a metal which is hard to form an alloy or an intermetallic compound with the metal constituting the conductive layer and has a low solid solubility to the conductive layer or an alloy thereof.

Also, according to a second aspect of the present invention, there is provided an electrode for a display device for a plasma display panel, comprising a transparent electrode and a bus electrode which has a narrower width than the transparent electrode and is completely covered by the transparent electrode, the bus electrode being a laminate of an underlying layer, a conductive layer and a protective layer formed on a substrate in this order from the substrate side in such a manner that at least the conductive layer is completely covered by the protective layer, the electrode being covered by a dielectric layer made of a low-melting glass, the underlying layer and the protective layer being composed of a metal which is hard to form an alloy or an intermetallic compound with the metal constituting the conductive layer and has a low solid solubility to the conductive layer.

Furthermore, according to a third aspect of the present invention, there is provided a method for manufacturing an electrode for a display device, comprising the steps of: forming an underlying layer on a substrate;

forming a conductive layer on the underlying layer;

forming a protective layer on the conductive layer by an electroless plating method in such a manner that the conductive layer is completely covered by the protective layer, wherein the ionization tendency of the metals constituting the underlying layer, the conductive layer and the protective layer becomes larger in the order of the underlying layer, the protective layer and the conductive layer.

Further, according to a fourth aspect of the present invention, there is provided a method for manufacturing an electrode for a display device, comprising the steps of:

forming an underlying layer on a substrate;

forming a conductive layer on the underlying layer;

forming a protective layer on the conductive layer by an electroless plating method in such a manner that the conductive layer is completely covered by the protective layer, wherein the ionization tendency of the metals constituting the underlying layer, the conductive layer and the protective layer becomes larger in the order of the underlying layer, the protective layer and the conductive layer, thereby forming a bus electrode comprised of the underlying layer, the-conductive layer and the protective layer; and forming a transparent electrode on the bus electrode in such a manner that the bus electrode has a narrower width than the transparent electrode and is completely covered by the transparent electrode.

BRIEF DESCRIPTION OF THE DRAWINGS

FIG. 12(*b*) is an SEM photograph of the cross-section after heating the above-described Ni/Cu/Cr;

DETAILED DESCRIPTION OF THE INVENTION

Figure 1A:
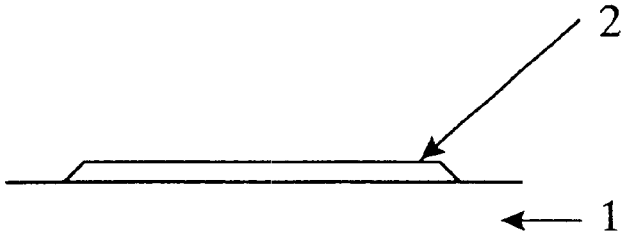
FIGS. 1(*a*) to 1(*e*) are schematic sectional views illustrating manufacturing steps for an electrode for a display device according to the present invention.
Figure 1B:
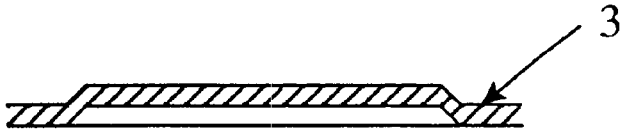
Figure 1C:
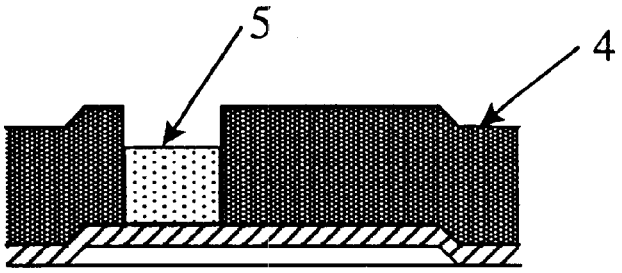
Figure 1D:
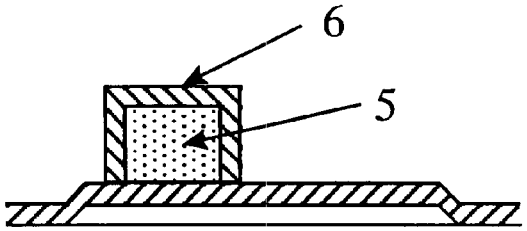
Figure 1E:
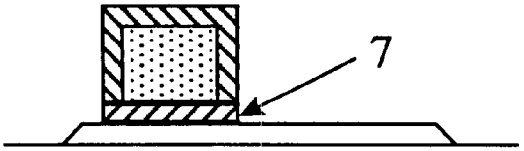
Figure 2A:
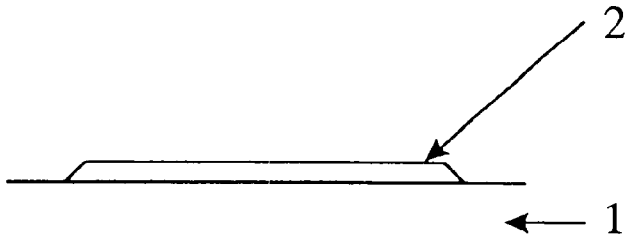
FIGS. 2(*a*) to 2(*e*) are schematic sectional views illustrating manufacturing steps for an electrode for a display device according to the present invention.
Figure 2B:
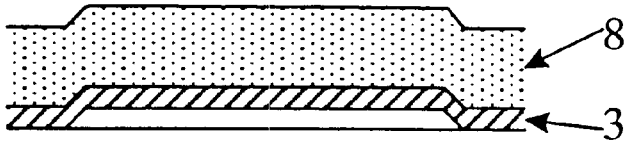
Figure 2C:
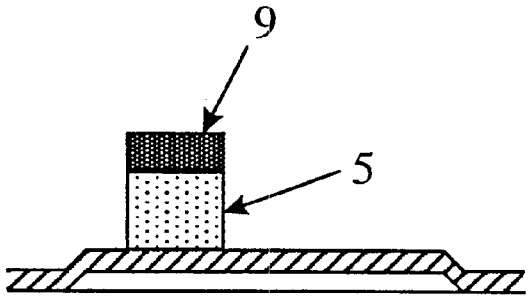
Figure 2D:
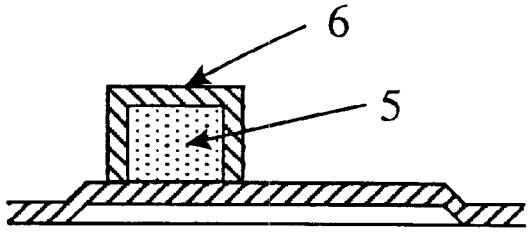
Figure 2E:
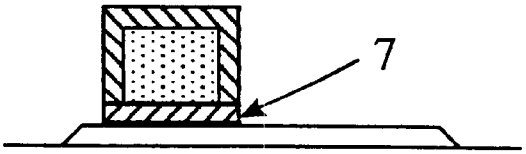
Figure 3A:
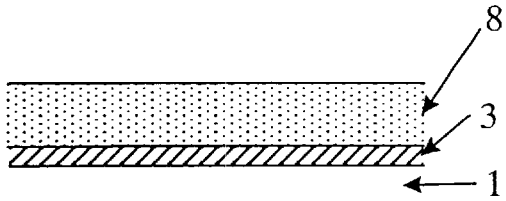
FIGS. 3(*a*) to 3(*f*) are schematic sectional views illustrating manufacturing steps for an electrode for a display device according to the present invention.
Figure 3B:
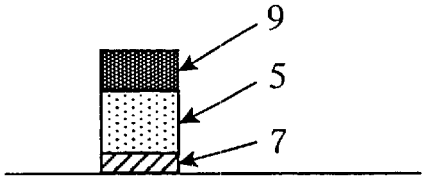
Figure 3C:
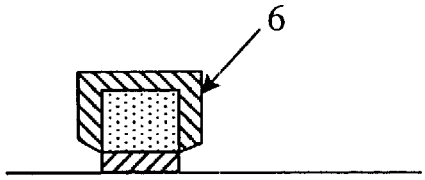
Figure 3D:
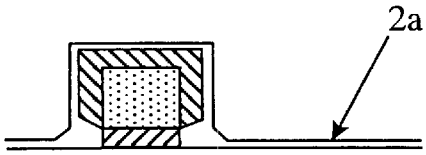
Figure 3E:
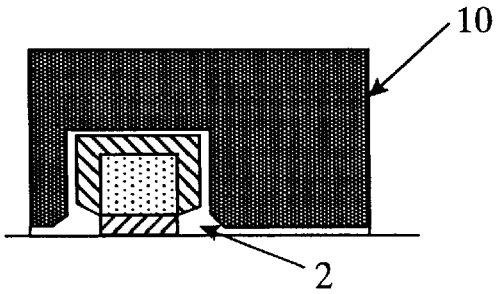
Figure 3F:
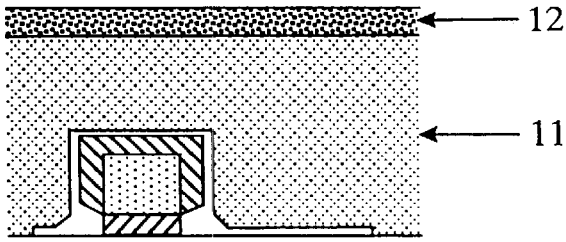
Figure 4A:
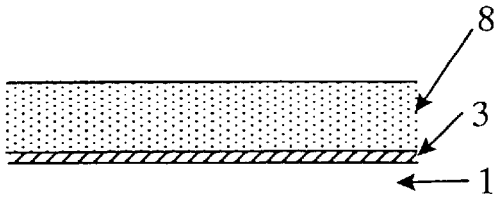
FIGS. 4(*a*) to 4(*f*) are schematic sectional views illustrating manufacturing steps for an electrode for a display device according to the present invention.
Figure 4B:
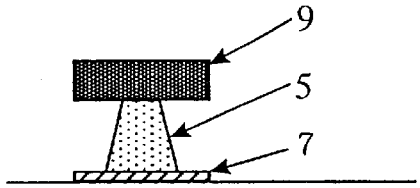
Figure 4C:
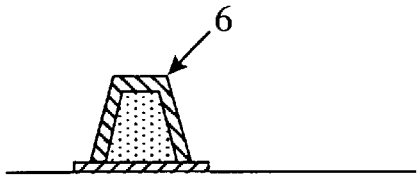
Figure 4D:
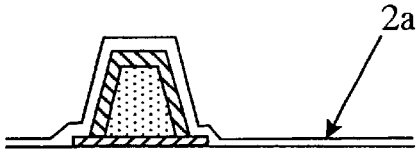
Figure 4E:
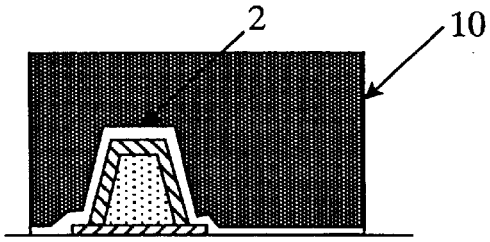
Figure 4F:
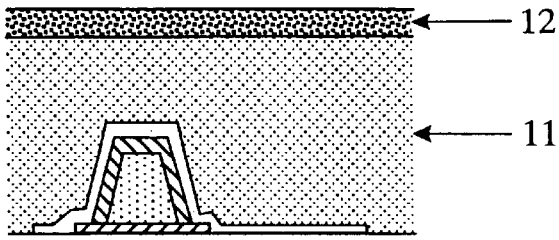
Figure 5A:
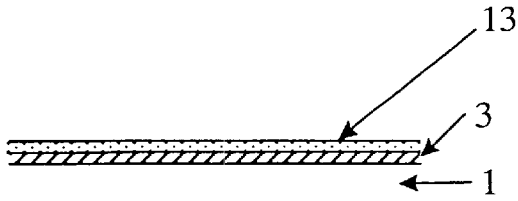
FIGS. 5(*a*) to 5(*f*) are schematic sectional views illustrating manufacturing steps for an electrode for a display device according to the present invention.
Figure 5B:
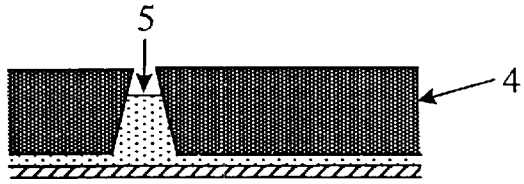
Figure 5C:
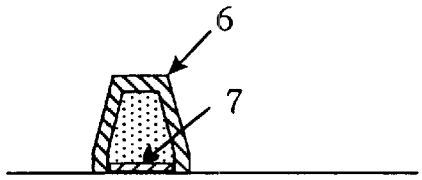
Figure 5D:
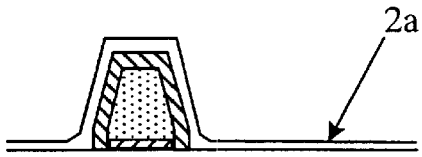
Figure 5E:
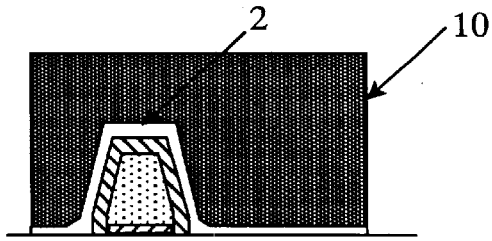
Figure 5F:
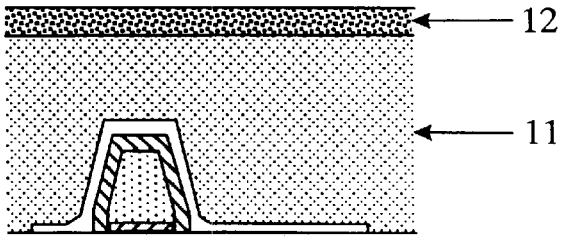
Figure 6A:
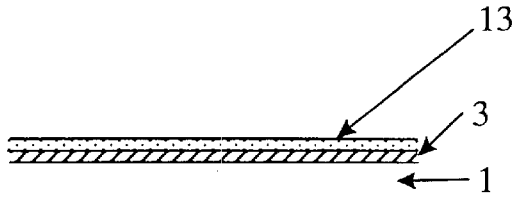
FIGS. 6(*a*) to 6(*f*) are schematic sectional views illustrating manufacturing steps for an electrode for a display device according to the present invention.
Figure 6B:
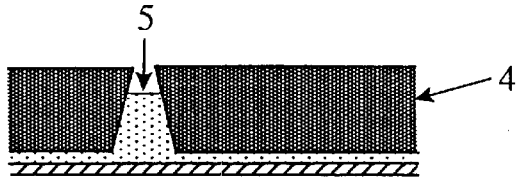
Figure 6C:
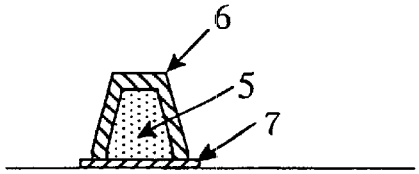
Figure 6D:
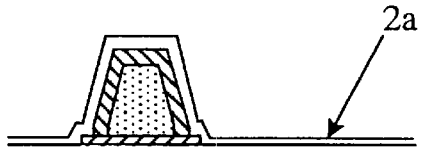
Figure 6E:
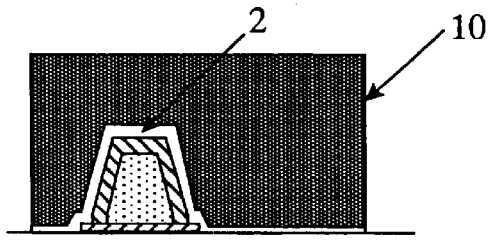
Figure 6F:
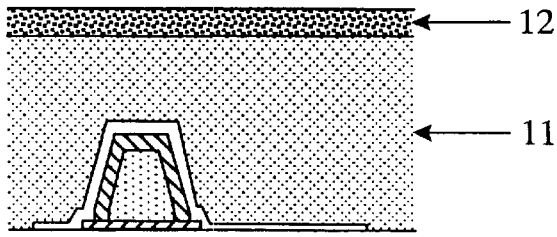

Then, the present invention is described in detail.

A substrate to be used in the present invention may have any construction if the substrate can form an electrode for display thereon. The substrate includes, for example, a substrate such as a silicon substrate, a glass substrate, a plastic substrate, and further a substrate having laminated thereon a transparent electrode, an insulating layer, or the like.

An electrode is formed on the substrate. On the substrate are laminated an underlying layer, a conductive layer and a protective later in this order from the substrate side such that at least the conductive layer is completely covered by the protective layer. By covering the conductive layer with the protective layer, diffusion of the metal constituting the conductive layer into a dielectric layer which is later formed on the electrode can be prevented.

It is preferred that the above-described underlying layer is constituted by a metal which is hard to form an alloy or intermetallic compound with the metal constituting the conductive layer. Also, it is preferred that the conductive layer comprises Cu. Furthermore, it is preferred that the protective layer comprises a metal which is hard to form an alloy or intermetallic compound with the metal constituting the conductive layer or an alloy thereof. In the case of considering the application to PDP, as the metal which is hard to form an alloy with Cu, it is a standard that the solid solubility of the metal in copper at 600° C. is not more than 1 at. %. The reason is that, when the solid solubility of the metal is not more than 1 at. %, an increase in resistivity of Cu can be restrained to about twice even in the production process. The metal satisfying such a condition is Cr, Mo, W, Fe, Co, Ta, Zr, or the like, according to the above-cited literature, "*Constitution of Binary Alloys*", 2nd Ed. (in addition, Re, Ru, and Os are also included in the above-described metal although the cost thereof is high). By using such a metal in combination, the system is thermodynamically stable, and the alloy formation or intermetallic compound formation reaction does not occur at the interface between the layers, whereby increase of the resistance by forming an alloy or intermetallic compound can be prevented. It is preferred that the thicknesses of the underlying layer, the conductive layer and the protective layer are from 0.05 to 0.5 μm, from 0.5 to 20 μm, and from 0.1 to 2.0 μm, respectively. Also, the width of the metal electrode is preferably from 10 to 300 μm.

In addition, the relationship between the resistivity of the conductive layer made of Cu and a metal constituting the protective layer is shown in Table 1 below. In this case, heating was carried out for 40 minutes at 600° C. in a nitrogen gas atmosphere.

TABLE 1

| | Metal For Constituting the Protective Lyaer | | | | | |
|---|---|---|---|---|---|---|
| | Ni | Ni | Co | Mo | W | Ta |
| Forming Method | Platg. | V.E. | Platg. | V.E. | V.E. | V.E. |
| Layer Thickness (μm) | 0.7 | 0.3 | 0.3 | 0.3 | 0.3 | 0.3 |
| Initial Sheet Resistance (Ω/□) | 0.0116 | 0.0104 | 0.0113 | 0.0105 | 0.0103 | 0.0111 |
| Sheet Resistance After Heating (Ω/□) | 0.0529 | 0.0682 | 0.0129 | 0.0100 | 0.0100 | 0.0109 |
| Resistance Change Ratio | 4.56 | 6.56 | 1.14 | 0.95 | 0.97 | 0.96 |
| Cu Layer Thickness (μm) | 1.8 | 1.8 | 1.8 | 1.8 | 1.8 | 1.7 |
| Cu Resistivity After Heating (μΩ · cm) | 9.52 | 12.3 | 2.32 | 1.80 | 1.80 | 1.85 |

In the above table, the terms "platg." and "V.E." mean the plating method and the vacuum evaporation method, respectively.

From Table 1 described above, it can be seen that the electrode having a protective layer made of Ni has a higher resistance after heating as compared with those having a protective layer made of a metal other than Ni. On the other hand, it is shown that the resistance of the protective layer constituting the electrode of the present invention is scarcely changed.

There is no particular restriction on the formation methods of the underlying layer and the conductive layer in the present invention. For example, there are a method that, after laminating metals constituting the respective layers by the vacuum evaporation method, the sputtering method, the electroplating method, the electroless plating method, or the like, a mask is formed in a desired region for forming the electrode, and by etching (the wet etching method or the dry etching method such as the reactive ion etching method can be used) using the mask, the layers are formed, a method that, after forming a mask having an opening in a desired region for forming the electrode, by laminating the metals constituting the respective layers by the electroplating method, the electroless plating method, or the like, the layers are formed, or the like. Of these methods, the method of using the electroplating method or the electroless plating method for laminating the metals is preferred because the layers can be produced at a low cost. In addition, as the etching solution used for the above-described wet etching, it is preferred to use an aqueous solution of hydrochloric acid in the case of Cr, or to use an aqueous solution of ferric chloride in the case of Cu. Also, the mask can be formed by using a known photoresist such as OFPR-800 (a trade name, made by Tokyo Ohka Kogyo Co., Ltd.), ZPP-1700 (a trade name, made by Nippon Zeon Co., Ltd.), or the like, by exposure and development.

Furthermore, there is no particular restriction on the forming method of the protective layer if the layer can be formed so that the layer covers the conductive layer, but it is particularly preferred to selectively (in self-alignment) form the protective layer on the conductive layer by the electroless plating method. In the case of other forming methods than the electroless plating method, because it is necessary to form the protective layer after protecting other layers than the conductive layer with a resist, or the like, the number of the production steps is increased, leading to a possibility of increase in the production cost. On the other hand, in the case of selective formation by the electroless plating method, because the protective step is unnecessary, and also, the electroless plating method itself is an inexpensive method, the production cost can be reduced. When the metal constituting the protective layer is Co, as the electroless plating liquid, there is, for example, a cobalt plating liquid, Conbus-M (a trade name, made by World Metal Co. Ltd.).

In addition, in the case of forming the protective layer by the electroless plating method, it is preferred that as the metals constituting the underlying layer, the conductive layer and the protective layer respectively, the metals having an ionization tendency such that it becomes larger in the order of the underlying layer, the protective layer and the conductive layer are used. By using the metals having such relations, because an electrochemical reaction occurs between the underlying layer and the conductive layer, the protective layer can selectively cover only the surface of the conductive layer.

Furthermore, before applying the electroless plating, by immersing in a catalyst solution for plating, such as a $PdCl_2$ solution, or the like, the catalyst may be coated at least on the surface of the conductive layer. Also, a known pretreatment such as degreasing, removal of a natural oxide film, or the like may be applied.

In the metals constituting each of the underlying layer, the conductive layer and the protective layer, particularly preferred combinations are a combination of Cr, Cu and Co, and a combination of Fe, Cu and Co.

Then, a dielectric layer is formed so that it covers the electrode. The dielectric layer is constituted by a low-melting glass, and its thickness is preferably from 10 to 30 μm. The dielectric layer can be formed, for example, by coating a low-melting glass paste on the whole surface of the substrate followed by sintering. In this case, the low-melting glass paste is generally composed of a low-melting glass powder containing lead oxide and/or zinc oxide as a principal component, a binder resin such as ethyl cellulose or the like, and a solvent such as α-terpineol or the like. Also, sintering is usually carried out at a temperature in the range from 400 to 700° C. When sintering is carried out within this temperature range, and the conductive layer is not covered by the protective layer, there is a possibility that the metal constituting the conductive layer diffuses into the dielectric layer, but in the present invention, because the conductive layer is covered by the protective layer, the diffusion of the metal can be prevented.

In the present invention, a transparent electrode may be formed between the substrate and the electrode, or between the dielectric layer and the electrode. In this case, as a material constituting the transparent electrode, there are ITO, NESA, and the like. The desired pattern made of ITO and NESA each can be obtained by forming a paste of organometallic compounds of the metals constituting each of them, coating and burning the paste. As a method other than the above method, they can be also formed by the sputtering method, the CVD method, or the like.

The thickness of the transparent electrode is preferably from 0.1 to 0.5 μm. Furthermore, it is particularly preferred that the transparent electrode is formed between the dielectric layer and the electrode, so as to cover the electrode. By forming the transparent electrode so as to cover the electrode, a barrier for preventing the metal constituting the conductive layer from diffusion into the dielectric layer can be formed as a double-layer structure. By forming the barrier as a triple- or more-multi layer structure, the prevention of the diffusion is more effective, but by forming the barrier as a double-layer structure by using the existing layers, it is advantageous for reducing the cost. In addition, patterning of the transparent electrode can be carried out by a known method such as the wet etching method, the dry etching method, the printing method, or the like. In the case of wet etching, for preventing the conductive layer from being simultaneously etched, it is preferred that the etching solution does not contain a solute having an oxidative effect, such as nitric acid, ferric chloride, or the like, and it is more preferred to use an aqueous solution of hydrochloric acid, or the like.

Now, in the case of forming the transparent electrode on the electrode, it is preferred that the form of the conductive layer is a taper in which the substrate side is wider: By making a taper form, the side walls of the electrode become gently-sloping, whereby occurrence of the disconnection of the transparent electrode can be prevented and the side walls of the electrode are easily covered with the transparent electrodes. The taper-form conductive layer can be formed, for example, by using a mask having a taper-form opening portion in which the substrate side is wider and filling a metal in the opening portion by the plating method, or the like. Furthermore, it is preferred that the conductive layer and/or the protective layer have/has a narrower width than the underlying layer. By making the width of the conductive layer narrower than the underlying layer, the difference in level formed by the electrode is mitigated, whereby occurrence of the disconnection of the transparent electrode can be prevented.

Figure 7:
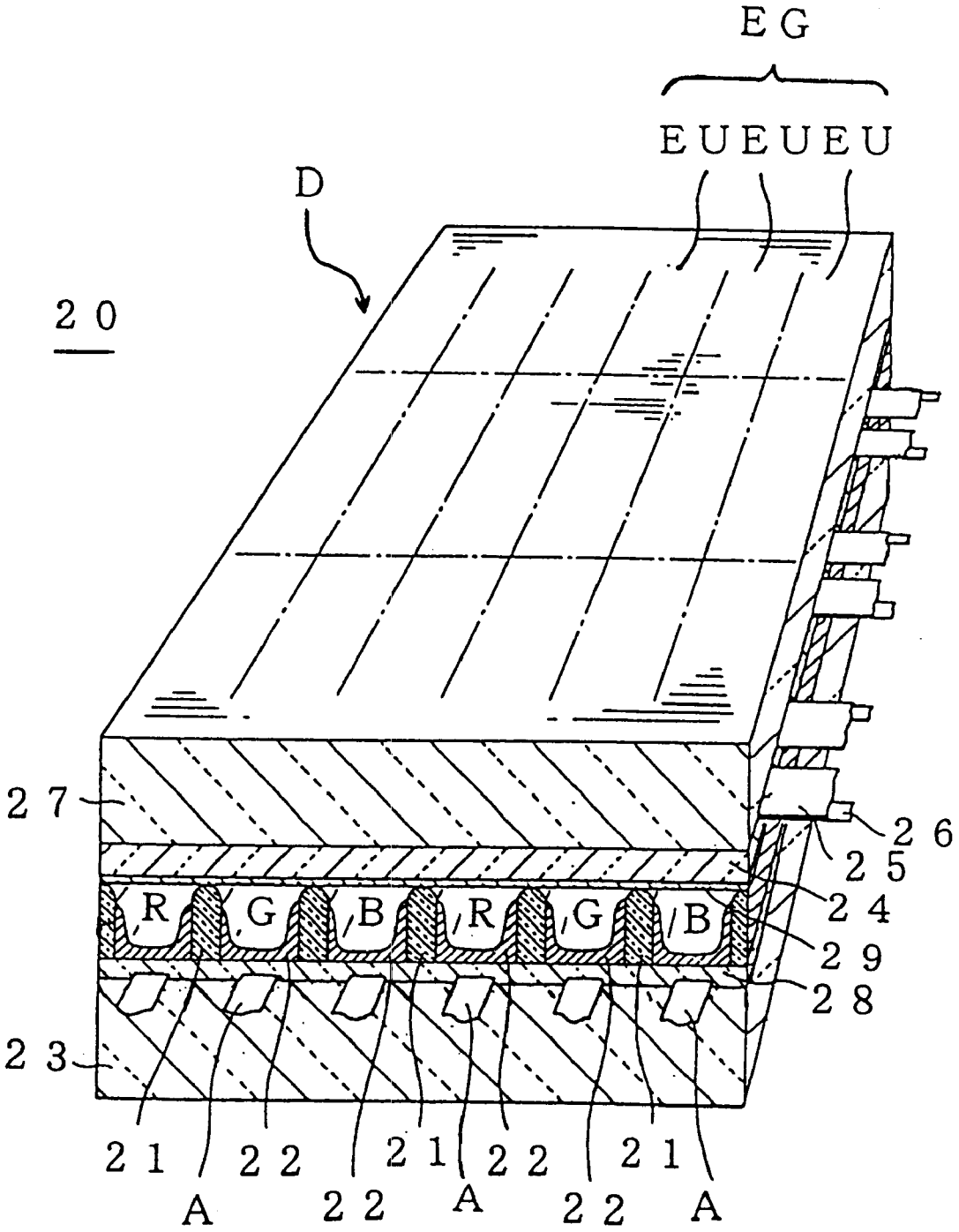
Fig. 7 PRIOR ART
FIG. 7 is a schematic perspective view of PDP.

The electrode for a display device and method for manufacturing the same of the present invention can be applied to any electrode of a display device having a substrate and an electrode covered with a dielectric layer. As such an electrode, there are, for example, a bus electrode and an address electrode (data electrode) for a display electrode in PDP, a scanning electrode and a signal electrode in LCD, respectively. More practically, by using the present invention for the bus electrode and the address electrode A of PDP having a construction as shown in FIG. 7, it becomes possible to form the electrode of a low resistance at a low cost. In addition, in FIG. 7, the address electrode A which is directly formed on the substrate 23 is covered by a dielectric layer 28, and the barrier rib 21 and the phosphor layer 22 are formed on the dielectric layer 28.

The following Examples are intended to illustrate the present invention more practically but not to limit the invention in any way.

EXAMPLE 1

The display electrode (two-layer electrode made of a transparent electrode and a bus electrode) of PDP was formed based on FIGS. 1(*a*) to 1(*e*).

An ITO film was formed on a substrate (glass substrate) 1 at a thickness of 4,000 Å. Thereafter, a photoresist was coated on the ITO film at a thickness of 3 μm, and by exposing and developing, a mask having an opening portion for forming a desired transparent electrode was formed. By using the mask, the ITO film was etched with an aqua regia to form a transparent electrode 2 [see, FIG. 1(*a*)].

Then, a Cr layer 3 which became an underlying layer was formed at a thickness of 1,000 Å by the sputtering method [see, FIG. 1(*b*)].

Furthermore, a photoresist was coated on the whole surface of the substrate, and by exposing and developing a region for forming a conductive layer on the transparent layer, a mask 4 having an opening portion in the instant region was formed. By using the mask 4, a conductive layer 5 made of Cu having a thickness of 2 μm was formed by the electroplating method [see, FIG. 1(*c*)]. In addition, the plating was carried out under the conditions such that an aqueous solution containing copper pyrophosphate as a principal component, i.e. 80 g/liter of copper pyrophosphate trihydrate, 270 g/liter of potassium pyrophosphate, and 3 ml/liter of aqueous ammonia were used for a plating liquid, the liquid temperature was 55° C., and that the anodic current density was 2 A/dm$^2$.

Then, after removing the mask 4, a protective layer 6 made of Co having a thickness of 3,000 Å was selectively formed on the surface of the conductive layer 5 by the electroless plating method [see, FIG. 1(*d*)]. In this case, a protective layer made of Co was not formed on the Cr layer 3 by the electrochemical reaction. In addition, the plating was carried out under the conditions so that Conbus-M (a trade name, made by World Metal Co. Ltd.) was used as the plating liquid, the liquid temperature was 80° C., and that the immersion time was 2 minutes.

Thereafter, by etching the Cr layer 3 using an aqueous solution containing 20% by weight of hydrochloric acid, the transparent electrode 2 was partially exposed to form a bus electrode composed of an underlying layer 7, the conductive layer 5 and the protective layer 6 [see, FIG. 1(*e*)].

Furthermore, although not shown in FIG. 1, by coating a low-melting glass paste on the substrate such that the coated layer covered the display electrode of a double-layer structure of the transparent electrode and the bus electrode, followed by sintering, a dielectric layer was formed. Then, by forming a surface protective layer made of MgO on the dielectric layer by the vacuum evaporation method, a display surface side substrate of PDP could be produced.

EXAMPLE 2

A display electrode of PDP was similarly formed based on FIGS. 2(*a*) to 2(*e*).

In the same manner as FIG. 1(*a*), a transparent electrode 2 was formed on a substrate 1 [see, FIG. 2(*a*)].

Then, a Cr layer 3 (underlying layer) having a thickness of 1,000 Å was formed on the substrate 1 by the sputtering method such that it covered the transparent electrode 2 and that a Cu layer 8 having a thickness of 2 μm was formed thereon by the electroplating method with copper pyrophosphate [see, FIG. 2(*b*)].

Then, a photoresist was coated on the whole surface of the substrate, and by exposing and developing, a mask 9 was formed in a desired region only for forming a conductive layer. Thereafter, by etching using an aqueous solution of ferric chloride, a conductive layer 5 of Cu was formed [FIG. 2(*c*)].

After removing the mask 9, by carrying out the same processes as in FIGS. 1(*d*) and 1(*e*), a display surface side substrate of PDP could be produced [see, FIGS. 2(*d*) and 2(*e*)].

EXAMPLE 3

A display electrode of PDP was formed based on FIGS. 3(*a*) to 3(*f*).

A Cr layer 3 and a Cu layer 8 were laminated on a substrate 1 in this order by the sputtering method at a thickness of 1,000 Å and 2 μm, respectively [see, FIG. 3(*a*)]

Then, a photoresist was coated on the whole surface of the substrate, and by exposing and developing, a mask 9 was formed in a desired region only for forming an electrode. Thereafter, by etching the Cu layer 8 using an aqueous solution of ferric chloride, a conductive layer 5 was formed. Furthermore, by etching the Cr layer 3 using an aqueous solution of hydrochloric acid, an underlying layer 7 was formed [see, FIG. 3(*b*)].

Thereafter, removal of the photoresist and degreasing were carried out by using an aqueous solution of sodium hydroxide, and then, a natural oxide film on the surface of the conductive layer 5 was removed by using organic acid such as acetic acid. Then, using a cobalt plating liquid, Conbus-M (a trade name, made by World Metal Co. Ltd.), a protective layer 6 made of Co having a thickness of 0.3 μm was selectively formed so that the protective layer covered the surface of the conductive layer 5. Thus, an electrode composed of the underlying layer 7, the conductive layer 5 and the protective layer 6 was formed on the substrate 1 [see, FIG. 3(*c*)].

Then, an ITO film 2*a* having a thickness of 0.3 μm was formed on the substrate 1 so that the film covered the electrode [see, FIG. 3(*d*)]. The ITO film 2*a* was formed by coating a paste containing an organometallic compound of indium and tin on the substrate 1, followed by sintering.

Then, a photoresist was coated on the whole surface of the substrate, and by exposing and developing the photoresist layer, a mask 10 having a thickness of 3 μm was formed in a desired region only for forming a transparent electrode. By wet-etching the ITO film 2*a* with an aqueous solution of hydrochloric acid using the mask 10, a transparent electrode 2 was formed, thereby a two-layer electrode made of the bus electrode covered with the transparent electrode could be formed [see. FIG. 3(*e*)].

After removing the mask 10, a low-melting glass paste made of a low-melting glass powder, ethyl cellulose (a binder resin) and α-terpineol (solvent) was coated on the whole surface of the substrate 1. By sintering the low-melting glass paste at a temperature from 400 to 700° C. in air, a dielectric layer 11 was formed. Thereafter, by forming a surface protective layer 12 made of MgO having a thickness of 1 μm on the dielectric layer 11 by the vapor deposition method, a display surface side substrate of PDP could be produced [see, FIG. 3(*f*)].

EXAMPLE 4

A display electrode of PDP was formed based on FIGS. 4(*a*) to 4(*f*).

In the same manner as in FIG. 3(*a*), a Cr layer 3 and a Cu layer 8 were laminated in this order on a substrate 1 [see, FIG. 4(*a*)].

Then, in the same manner as in FIG. 3(*b*), by etching the Cr layer 3 and the Cu layer 8 using a mask 9, an underlying layer 7 was formed. Thereafter, by further side-etching the side surfaces of the Cu layer 8 using an aqueous solution of ferric chloride, a conductive layer 5 was formed [see, FIG. 4(*b*)].

After removing the mask 9, by following the same procedures as in FIGS. 3(*c*) to 3(*f*), a display surface side substrate of PDP could be produced [see, FIGS. 4(*c*) to 4(*f*)].

EXAMPLE 5

The same procedure as in FIG. 3(*a*) was carried out except that a Cu layer 8 having a thickness of 2 μm was formed by the electroplating method using an aqueous solution containing copper sulfate and sulfuric acid, and before forming the Cu layer 8, a Cu layer having a thickness of 1,000 Å was formed on a Cr layer 3 by the sputtering method.

As a process other than the above-described process, by carrying out the same processes as in FIGS. 3(*b*) to 3(*f*), a display surface side substrate of PDP could be produced.

EXAMPLE 6

The same procedure as in FIG. 3(*a*) was carried out except that a Cu layer 8 having a thickness of 2 μm was formed by an electroplating method using an aqueous solution containing copper sulfate and sulfuric acid, a Co layer 3 having a thickness of 1,000 Å was formed by the electroless plating method, and before forming the Cu layer 8, a Cu layer having a thickness of 1,000 Å was formed on a Co layer 3 by the electroless plating method. In addition, before forming the Co layer 3, the surface of a substrate 1 was roughened using an aqueous solution of hydrofluoric acid.

By carrying out the same processes as in FIGS. 3(*b*) to 3(*f*) except the above-described process, a display surface side substrate of PDP could be produced.

EXAMPLE 7

A display electrode of PDP was formed based on FIGS. 5(*a*) to 5(*e*).

First, a Cr layer 3 having a thickness of 1,000 Å and a Cu layer 13 having a thickness of 1,000 Å were formed on a substrate 1, respectively by the sputtering method [see, FIG. 5(*a*)].

Furthermore, a photoresist was coated on the whole surface of the substrate in a thickness of 5 μm, and by exposing and developing a desired region for forming a conductive layer on a transparent electrode, a mask 4 having an opening portion in the above-described region was formed. By using the mask 4, a conductive layer 5 made of Cu having a thickness of 2 μm was formed by the electroplating method [see, FIG. 5(*b*)]. In addition, the plating was carried out under the conditions so that an aqueous solution containing acidic copper sulfate as a principal component (Microfab, a trade name, made by EEJA Co.) was used as a plating liquid, the liquid temperature was 30° C., and that the current density was $2A/dm^2$.

After removing the mask 4, by following the same procedures as in FIGS. 3(*c*) to 3(*f*), a display surface side substrate of PDP could be produced [see, FIGS. 5(*c*) to 5(*f*)].

EXAMPLE 8

By following the same procedures as in FIGS. 5(*a*) to 5(*f*) except that after roughening a substrate 1 using an aqueous solution of hydrofluoric acid, a Co layer 3 and a Cu layer 13 were formed, respectively by the electroless plating method, a display surface side substrate of PDP could be produced. Because Cr could not be formed by the electroless plating method, Co was used for the underlying layer.

EXAMPLE 9

A display electrode of PDP was formed based on FIGS. 6(*a*) to 6(*f*).

By the same process as in FIG. 5(*a*), a Cr layer 3 and a Cu layer 13 were laminated, respectively on a substrate in this order [see, FIG. 6(*a*)].

Then, by the same process as in FIG. 5(*b*), a mask 4 was formed, and by using the mask 4, a conductive layer 5 was formed on the Cu layer 13. After removing the mask 4, side-etching was further applied to the side surfaces of the conductive layer 5 using an aqueous solution of ferric chloride [see, FIG. 6(*b*)].

Thereafter, by following the same procedures as in FIGS. 5(*c*) to 5(*f*), a display surface side substrate of PDP could be produced [see. FIGS. 6(*c*) to 6(*f*)].

EXAMPLE 10

By following the same procedures as in FIGS. 6(*a*) to 6(*f*) except that after roughening the surface of a substrate 1 using an aqueous solution of hydrofluoric acid, a Co layer 3 and a Cu layer 13 were formed, respectively by the electroless plating method, a display surface side substrate of PDP could be produced.

Comparative Example 1

Figure 8:
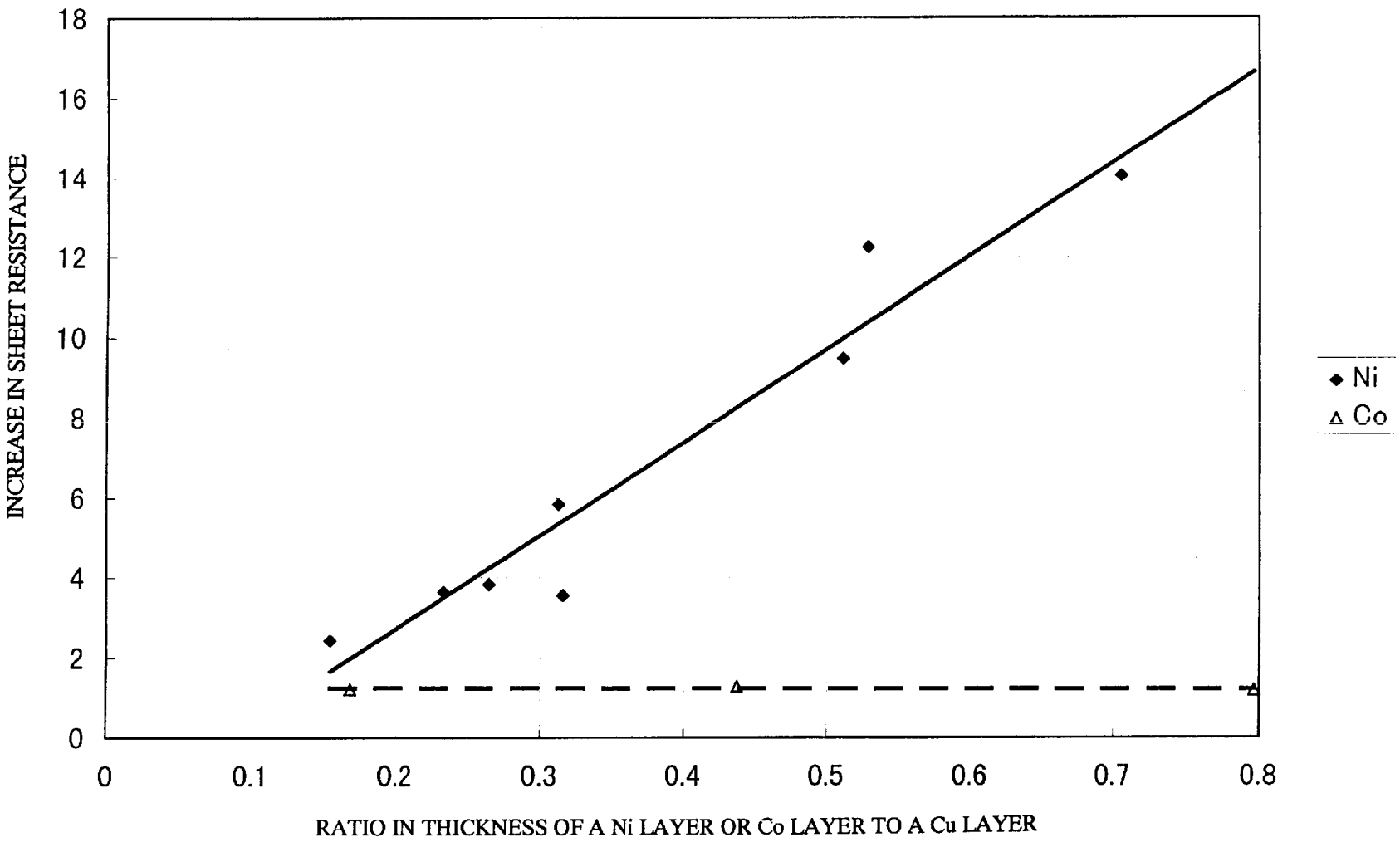
FIG. 8 is a graphical representation illustrating an increase in sheet resistance related to a ratio in thickness of a Ni layer or Co layer to a Cu layer.

First, an underlying Cr layer having a thickness of 500 Å and a Cu layer having a thickness of 1000 Å were formed respectively by the sputtering method. Then a Cu layer having a thickness of 2 μm was formed on a glass substrate by the electroplating method. Then a Ni Layer which was liable to form an alloy of Cu was formed on the Cu layer by the electroless plating method. The resulting laminate of Ni and Cu was subjected to thermal treatment at 600° C. for 40 minutes. The obtained result of sheet resistance of the laminated film before and after thermal treatment is shown in FIG. 8. FIG. 8 is a graphical representation illustrating an increase in sheet resistance related to a ratio in thickness of the Ni layer to the Cu layer.

As is apparent from the FIG. 8, Ni easily forms an alloy of Cu, so that the sheet resistance increases up to 14 times larger than that before the thermal treatment. Accordingly, it is proved that a combination of Ni and Cu is not preferred as an electrode material.

An electrode composed of an underlying Cr layer of a thickness of 500 Å, a Cu layer of a thickness of 2 μm and a Co layer of a various thickness were formed on a glass substrate. Then, a resistance of the electrode subjected to the same thermal treatment as mentioned above was measured. The result thereof is shown in FIG. 8. A horizontal axis in FIG. 8 shows a ratio is thickness of the Co layer to the Cu layer. As is seen in FIG. 8, a rate of increase in sheet resistance by thermal treatment is stable and about 20%. This result shows usefulness of electrodes coated with the Co layer according to the present invention.

EXAMPLE 11

Figure 9A:
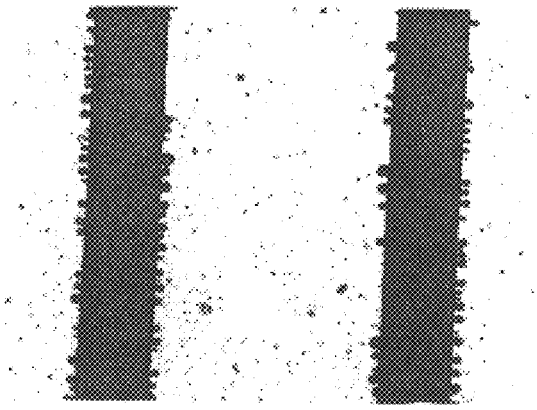
FIGS. 9(*a*) to 9(*c*) are SEM photographs showing states of an electrode after thermal treatment in Example 11.
Figure 9B:
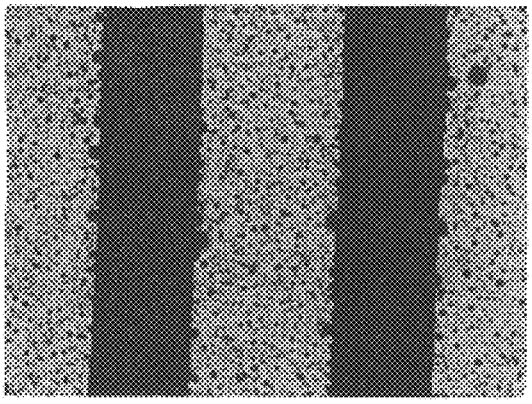
Figure 9C:
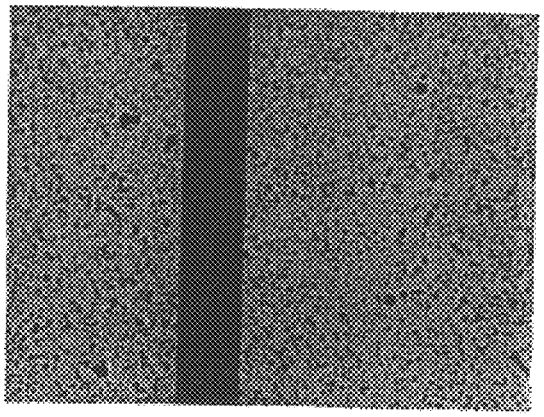
Figure 10A:
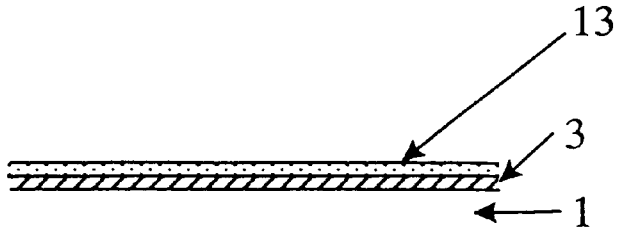
FIGS. 10(*a*) to 10(*e*) are schematic sectional views illustrating manufacturing steps for an electrode for a display device according to the present invention.
Figure 10B:
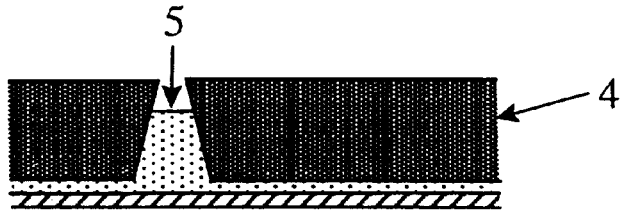
Figure 10C:
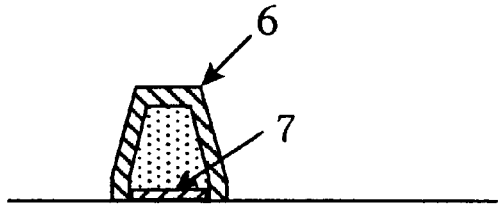
Figure 10D:
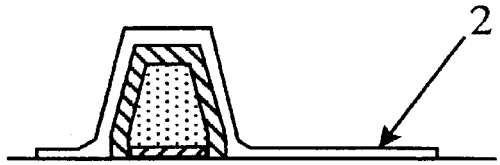
Figure 10E:
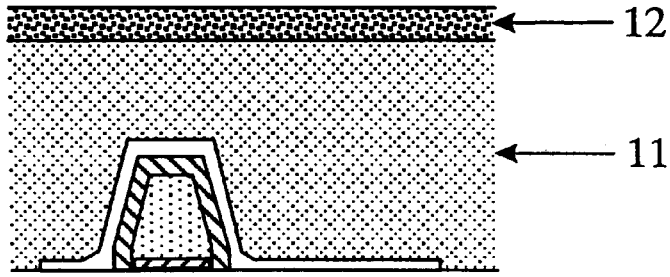
Figure 11A:
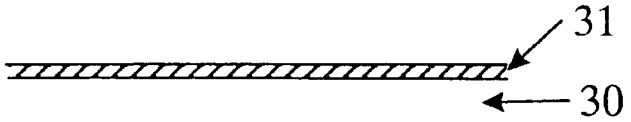
Fig. 11(a) Prior art
FIGS. 11(*a*) to 11(*d*) are schematic sectional views illustrating conventional manufacturing steps for an electrode for a display device.
Figure 11B:
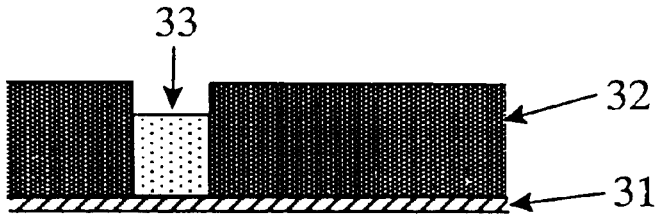
Fig. 11(b) Prior art
Figure 11C:
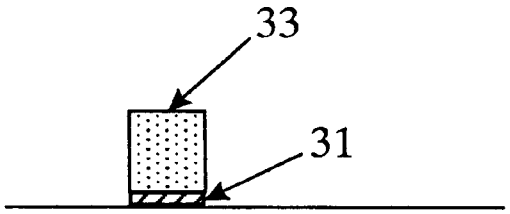
Fig. 11(c) Prior art
Figure 11D:
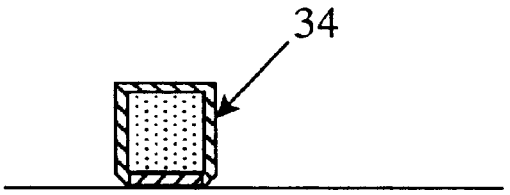
Fig. 11(d) Prior art
Figure 12A:
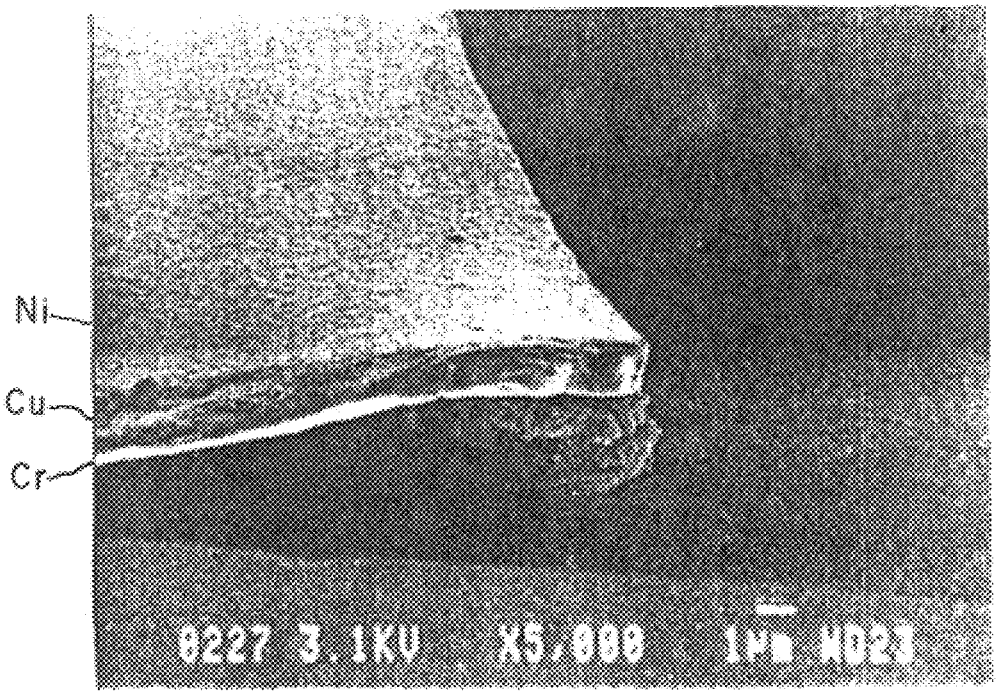
Fig. 12(a) PRIOR ART
FIG. 12(*a*) is an SEM photograph of the cross-section of an electrode made of Ni/Cu/Cr.
Figure 12B:
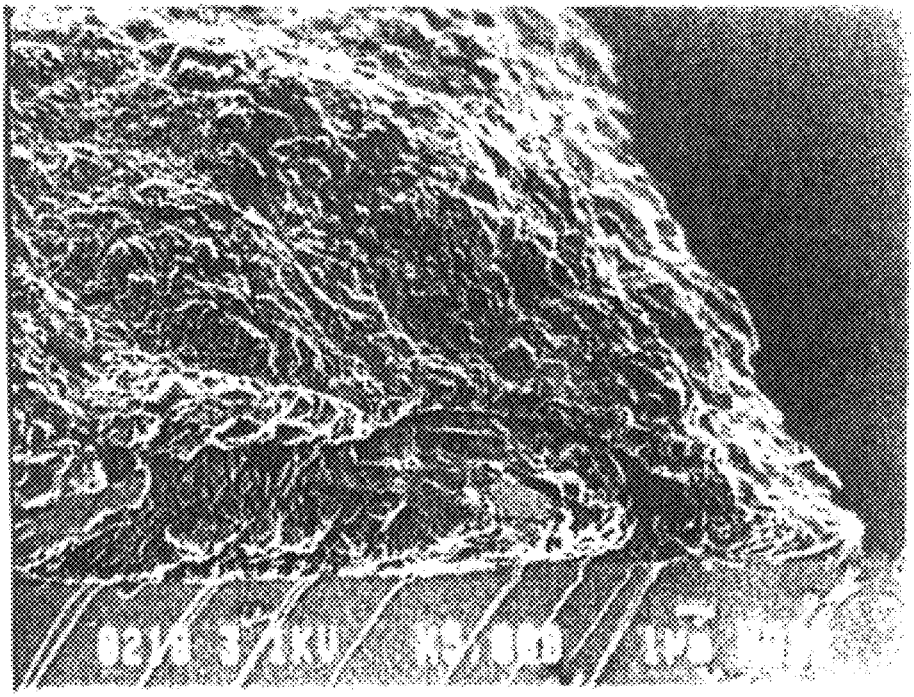
Fig. 12(b) PRIOR ART
Figure 13A:
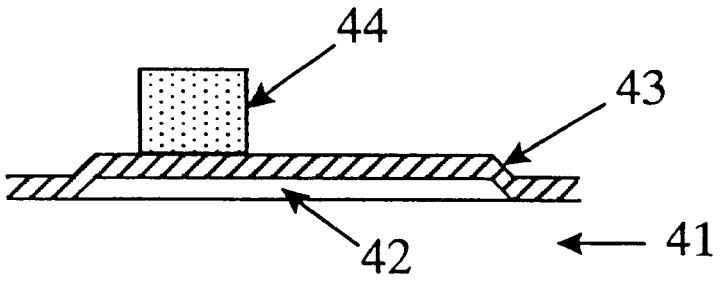
Fig. 13(a) Prior art
FIGS. 13(*a*) to 13(*c*) are schematic sectional views illustrating conventional manufacturing steps for an electrode for a display device.
Figure 13B:
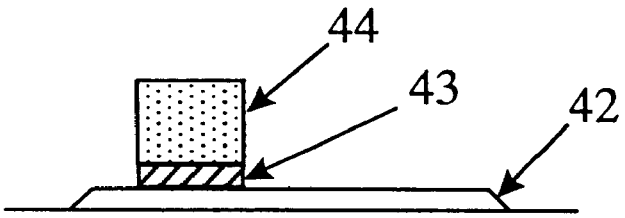
Fig. 13(b) Prior art
Figure 13C:
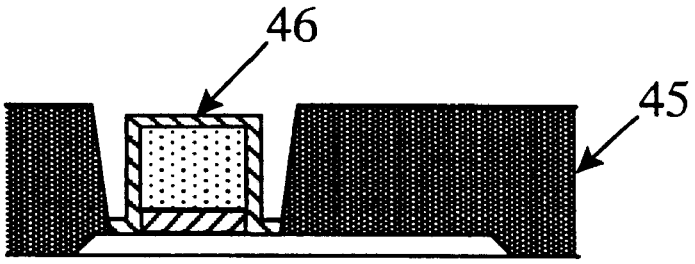
Fig. 13(c) Prior art

After a Cr layer having a thickness of 500 Å, a Cu layer having a thickness of 2 μm and a Cr layer having a thickness of 0.2 μm were laminated in this order on a glass substrate, a striped electrode was obtained by etching. The electrode was covered with a dielectric layer made of a glass material (PLS-3235, a trade name, made by Nippon Denki Glass Co., Ltd.). A state of the electrode after thermal treatment at 600° C. for 40 minutes (SEM photography) is shown in FIG. 9(*a*), as a comparative example. As is apparent from FIG. 9(*a*), air bubbles appeared at the interface between the dielectric layer and the electrode in the case of the combination Cr—Cu—Cr. It is considered that these air bubbles were generated because the materials constituting the electrode were diffused into the dielectric layer.

An electrode was formed in substantially the same manner as described before except that the Cu layer was completely covered with a Co layer having a thickness of 0.3 μm instead of the Cr layer having a thickness of 0.2 μm which did not cover the side walls of a Cu layer, followed by thermal treatment. A state of the electrode after thermal treatment is shown in FIG. 9(*b*) (SEM photography), as an example of the present invention. As is apparent from FIG. 9(*b*) compared with FIG. 9(*a*), generated air bubbles were much decreased in the case of the combination Cr—Cu—Co.

An electrode was formed in substantially the same manner as described before except that an electrode made of the combination Cr—Cu—Co was covered with a transparent electrode made of ITO film having a thickness of 0.2 μm, followed by thermal treatment. A state of the electrode after thermal treatment is shown in FIG. 9(*c*) (SEM photography), as a example of the present invention. As is apparent from FIG. 9(*c*) compared with FIGS. 9(*a*) and (*b*), generated air bubbles were vanished.

EXAMPLE 12

A display electrode of PDP was formed based on FIGS. 10(*a*) to 10(*e*). By the same process as in FIG. 5(*a*) to 5(*c*), an electrode composed of an underlying layer 7, a conductive layer 5 and a protective layer 6 was formed on a substrate 1 [see, FIG. 10 to 10(*c*)].

By the printing method, a paste including an organometallic compound of indium and tin was coated onto a desired region for forming a transparent electrode. Next, by calcining the paste, a transparent electrode 2 made from ITO was formed [see FIG. 10(*d*)). By using the printing method for preparing the transparent electrode, the process for forming a mask and an etching process as shown in FIG. 5(*d*) and 5(*e*) can be omitted.

Next, by forming a dielectric layer 11 and a surface protective layer 12 through the same procedures as in FIG. 5(*f*), a display surface side substrate of PDP could be produced.

Because, according to the electrodes for display devices of the present inventions, the conductive layer completely covered with the protective metal layer and the transparent electrode layer between the metal and the insulating film layer can be prevented from diffusion into the dielectric layer formed on the electrode, the display is not disturbed by coloring of the dielectric layer. Also, it is possible to prevent a case in which the resistance of the conductive layer is increased by the reaction of the conductive layer and the surrounding metals.

Also, according to the method for manufacturing the electrode of a display device of the present invention, because the protective layer can be formed so that the protective layer selectively covers the surface of the conductive layer, the increase in the production cost by the increase of the number of steps can be prevented.

What we claim is:

1. A method for manufacturing an electrode for a display device, comprising the steps of:

forming an underlying layer on a substrate;

forming a conductive layer on the underlying layer;

forming a protective layer on the conductive layer by the electroless plating method in such a manner that the conductive layer is completely covered by the protective layer, wherein the ionization tendency of the metals constituting the underlying layer, the conductive layer and the protective layer becomes larger in the order of the underlying layer, the protective layer and the conductive layer.

2. The method for manufacturing an electrode for a display device of claim 1, wherein the underlying layer comprises Cr, Fe or an alloy thereof, the conductive layer comprises Cu, and the protective layer comprises Mo, W, Fe, Co, Ta, Zr or an alloy thereof.

3. The method for manufacturing an electrode for a display device of claim 1, wherein the underlying layer, the protective layer or the conductive layer is formed by the plating method.

4. The method for manufacturing an electrode for a display device of claim 1, wherein the conductive layer is formed by the electroplating method.

5. The method for manufacturing an electrode for a display device of claim 1, wherein the conductive layer is formed by using a mask having a taper-form opening portion in which the substrate side is wider.

6. A method for manufacturing an electrode for a display device, comprising the steps of:

forming an underlying layer on a substrate;

forming a conductive layer on the underlying layer;

forming a protective layer on the conductive layer by the electroless plating method in such a manner that the conductive layer is completely covered by the protective layer, wherein the ionization tendency of the metals constituting the underlying layer, the conductive layer and the protective layer becomes larger in the order of the underlying layer, the protective layer and the conductive layer, thereby forming a bus electrode comprised of the underlying layer, the conductive layer and the protective layer; and forming a transparent electrode on the bus electrode in such a manner that the bus electrode has a narrower width than the transparent electrode and is completely covered by the transparent electrode.

* * * * *